US005992858A

United States Patent [19]

Teaster

[11] Patent Number: 5,992,858

[45] Date of Patent: Nov. 30, 1999

[54] DEVICE USED IN SEALING TIE REINFORCEMENT HOLES

[76] Inventor: Sherrill Dean Teaster, 16216 13 Mile Rd., Beverly Hills, Mich. 48025

[21] Appl. No.: 08/780,692

[22] Filed: Jan. 8, 1997

Related U.S. Application Data

[60] Provisional application No. 60/015,742, Apr. 15, 1996.

[51] Int. Cl.[6] ..... F16J 15/00

[52] U.S. Cl. ..... 277/650; 277/934

[58] Field of Search ..... 277/603, 605, 277/627, 630, 650, 934; 52/514, 741.4, 742.13

[56] References Cited

U.S. PATENT DOCUMENTS

| | | |
|---|---|---|
| 2,729,472 | 1/1956 | Pennella . |
| 2,860,489 | 9/1958 | Townsend . |
| 3,308,585 | 3/1967 | Fisher et al. . |
| 3,895,466 | 7/1975 | Melton . |
| 3,921,800 | 11/1975 | Burns . |
| 4,062,165 | 12/1977 | Marks et al. . |
| 4,126,005 | 11/1978 | Coursen . |
| 4,126,009 | 11/1978 | Tomic . |
| 4,139,323 | 2/1979 | Bandstetter . |
| 4,252,474 | 2/1981 | Jan Botes . |
| 4,329,540 | 5/1982 | Howarth . |
| 4,352,693 | 10/1982 | Langdon . |
| 4,372,708 | 2/1983 | Bower, Jr. et al. . |
| 4,622,436 | 11/1986 | Kinnan . |
| 4,637,618 | 1/1987 | Valls . |
| 4,754,590 | 7/1988 | Gordom . |
| 4,758,003 | 7/1988 | Goldstein et al. . |
| 4,943,185 | 7/1990 | McGuckin et al. . |
| 5,042,961 | 8/1991 | Scott et al. . |
| 5,098,228 | 3/1992 | Mauthe . |
| 5,738,146 | 4/1998 | Abe . |
| 5,813,677 | 9/1998 | Preisendoerfer . |

FOREIGN PATENT DOCUMENTS

| | | |
|---|---|---|
| 4022428 | 1/1992 | Germany . |
| 4140616 | 6/1993 | Germany . |
| 403036369 | 2/1991 | Japan . |
| 406057832 | 3/1994 | Japan . |

*Primary Examiner*—Anthony Knight
*Assistant Examiner*—John L. Beres
*Attorney, Agent, or Firm*—Lynn E. Cargill

[57] ABSTRACT

The method includes inserting a first stopper into the tie reinforcement hole, inserting a polymeric sealing material into the hole; inserting a second stopper into the hole, and pushing the second stopper into the hole until it compresses the polymeric sealing material between the first and second stoppers. A plunger-type device includes a container; a sealed compartment in the container containing a hardenable polymeric component; and a sealed compartment in the container containing a hardener. Another device includes an elongated body having an outside surface and two stopping elements protruding from the outside surface of the elongated body. Another device includes a tube formed of porous material enclosing a) two frangible cells, one containing a hardenable polymeric component and the other containing a hardener and b) a breaking element for breaking open the frangible cells. Another device includes a plug; two sealed compartments inside the plug, one containing a hardenable polymeric component and the other containing a hardener; and an elongated member extending from the plug which is adapted so that, when it is pulled from the plug, the sealed compartments are opened so that their contents may contact each other.

9 Claims, 3 Drawing Sheets

FIG. 1
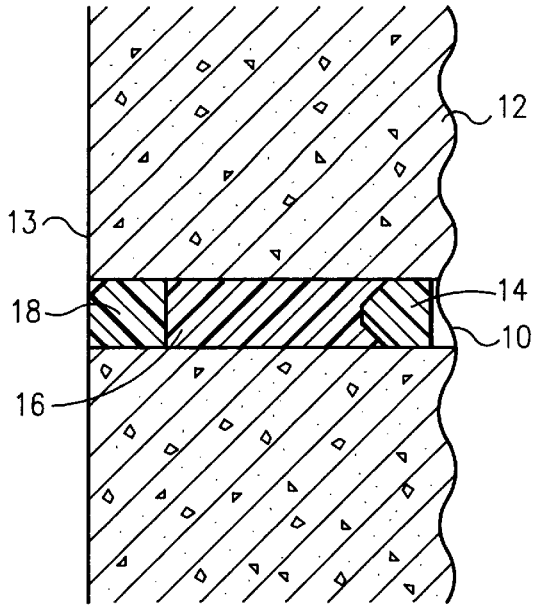
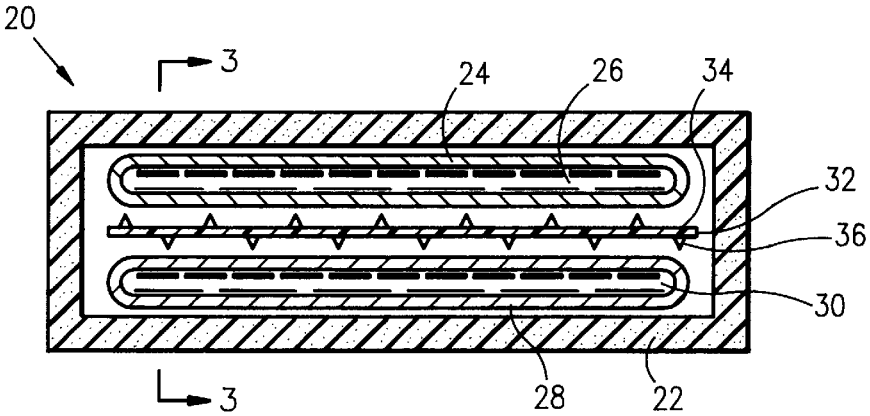
FIG. 2
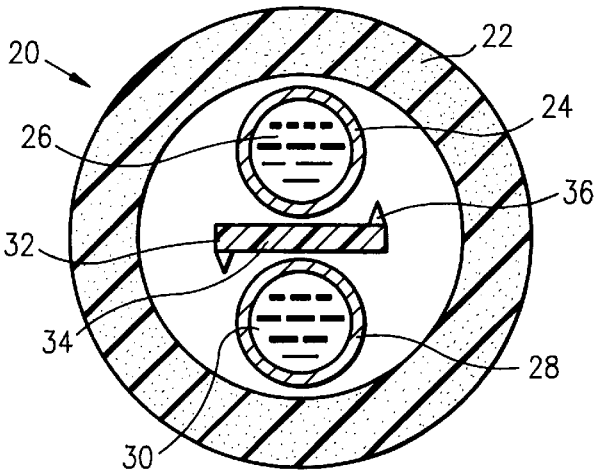
FIG. 3

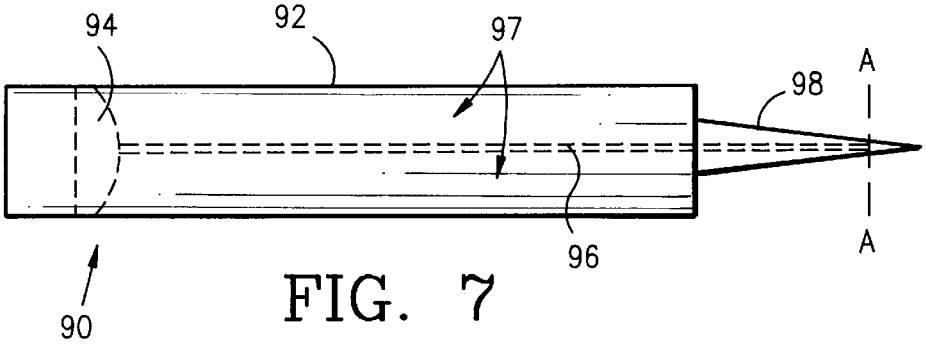
FIG. 7
FIG. 8
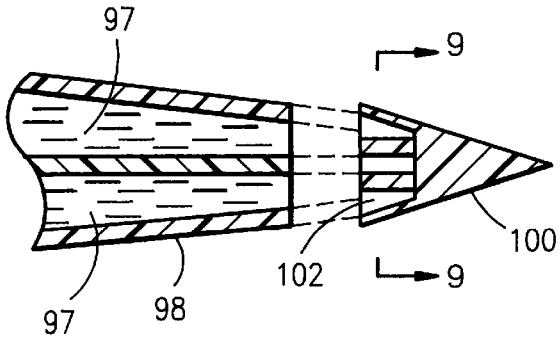
FIG. 9
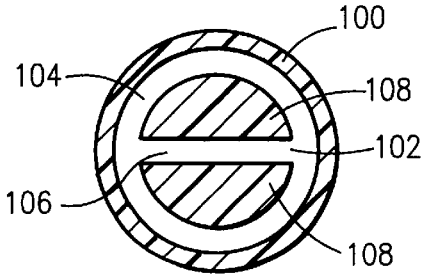
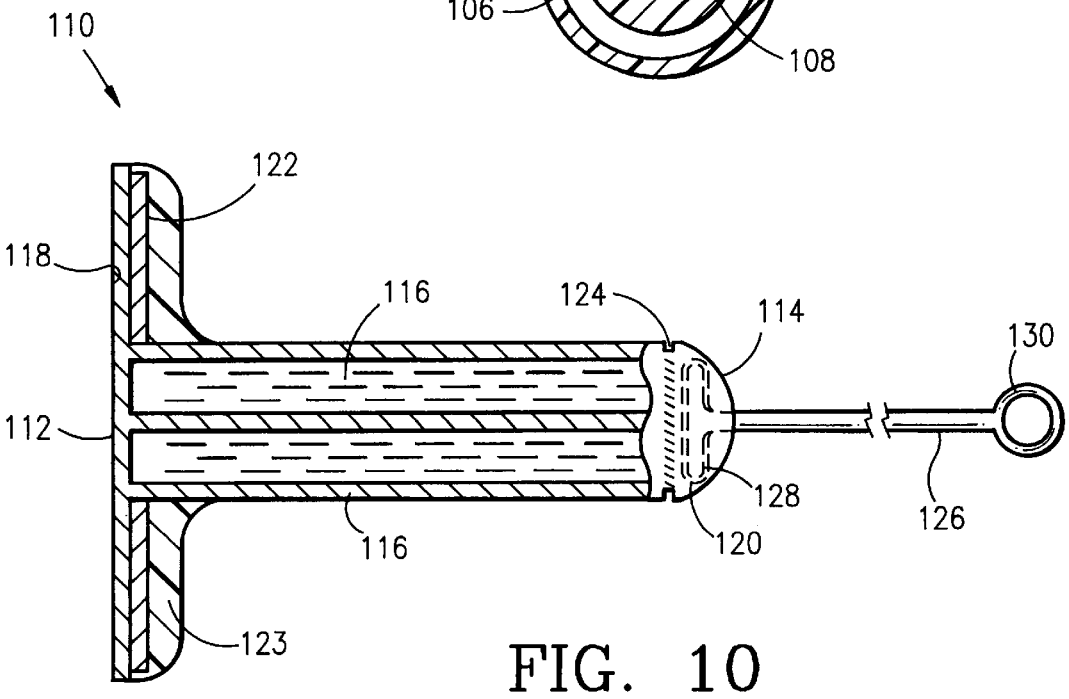
FIG. 10

DEVICE USED IN SEALING TIE REINFORCEMENT HOLES

This application claims benefit of Provisional application Ser. No. 60/015,742 filed Apr. 15, 1996.

BACKGROUND OF THE INVENTION

1. Field of the Invention

The present invention relates generally to methods for and devices used in sealing tie reinforcement holes found in concrete walls of foundations of buildings and homes, and, more particularly, to methods for and devices used in sealing tie reinforcement holes, which methods and devices use polymeric sealing materials.

2. Description of the Related Art

In the construction industry, the formation of homes or buildings with basements begins with excavation of the soil to make room for the basement. Especially in the U.S. and Canada, to form the walls of the basement, a wooden framework, called "shuttering", is then constructed. The shuttering is secured in place with steel rods, called "tie reinforcement rods". The shuttering serves as a frame into which concrete is poured and allowed to set to form the walls of the basement.

Once the concrete hardens, the shuttering and tie reinforcement rods are dismantled and removed, leaving holes extending from the inside (the basement side) of the concrete walls to the outside (the soil side) of the concrete walls. It is necessary to seal the tie reinforcement holes to avoid water leakage from the soil side into the basement. After sealing the tie reinforcement holes, soil is back-filled into the excavation cavity surrounding the basement.

Various methods have been presented in the past for sealing the tie reinforcement holes; however there remains a need for easy methods and easy-to-use devices for sealing tie reinforcement holes which are more effective than prior methods and devices.

It is, therefore, one object of the present invention to provide a method and a device for sealing tie reinforcement holes in concrete walls.

It is yet another object of the present invention to provide an easy method and an easy-to-use device for sealing tie reinforcement holes in concrete walls.

It is another object of the present invention to provide a more effective method and a more effective device for sealing tie reinforcement holes than prior methods and devices.

SUMMARY OF THE INVENTION

To achieve the foregoing objects, one embodiment of the present invention is a method for sealing a tie reinforcement hole in a concrete wall. The method includes inserting a first stopper into the tie reinforcement hole, inserting a polymeric sealing material into the tie reinforcement hole; inserting a second stopper into the tie reinforcement hole so that the second stopper is placed on the end of the polymeric sealing material opposite the first stopper, and pushing the second stopper into the tie reinforcement hole until it compresses the polymeric sealing material between the first and second stoppers. The first and second stoppers have diameters at least about as large as the diameter of the tie reinforcement hole. Typically, the first and second stoppers each have a first end and a second end, the first ends having smaller diameters than the corresponding second ends, and the second ends having diameters at least about as large as the diameter of the tie reinforcement hole.

Another embodiment of the present invention is a device for inserting a sealing material into a tie reinforcement hole. The device includes a container having two ends; a first sealed compartment in the container, the first sealed compartment containing a hardenable polymeric component; a second sealed compartment in the container, the second sealed compartment containing a hardener for the hardenable polymeric component; an outlet on one end of the container leading from inside the container to outside the container; and a plunger on the other end of the container, the plunger for forcing the contents of the container out of the container. The first and second sealed compartments are sealed so that the hardenable polymeric component and the hardener do not come in contact until use of the device.

Yet another embodiment of the present invention is a device for assisting in the sealing of a tie reinforcement hole. The device includes an elongated body having an outside surface, a first end and a second end and first and second stop means protruding from the outside surface of the elongated body. The first stop means is closer to the first end of the elongated body than the second stop means, and the distance from the first end to the first stop means is farther than the distance from the second end to the second stop means.

Still another embodiment of the present invention is a device for sealing a tie reinforcement hole. The device includes a cylindrical tube having walls formed of porous material. Inside the cylindrical tube are a) a sealed, frangible cell containing a hardenable polymeric component; b) a sealed, frangible cell containing a hardener for hardening the hardenable polymeric component; and c) means for breaking open the frangible cells to allow the hardenable polymeric component and the hardener to contact each other.

A further embodiment of the present invention is another device for sealing a tie reinforcement hole. The device includes a plug having a first end and a second end; first and second sealed compartments inside the plug, the first sealed compartment containing a hardenable polymeric component and the second sealed compartment containing a hardener for the hardenable polymeric component; and an elongated member extending from the first end of the plug. The elongated member is adapted so that, when the elongated member is pulled from the plug, a portion of the plug is removed and the first and second sealed compartments are opened so that the contents of the sealed compartments may contact each other.

Other objects, features, and advantages of the present invention will be readily appreciated as the same becomes better understood after reading the subsequent description taken in conjunction with the appendant drawings.

BRIEF DESCRIPTION OF THE DRAWINGS

FIG. 1 is a cross-sectional view illustrating a method of sealing a tie reinforcement hole according to the present invention.

FIG. 2 is a cross-sectional view of a device according to the present invention, which device is useful in sealing a tie reinforcement hole.

FIG. 3 is a cross-sectional view of the device of FIG. 2, the cross section taken along line 3—3.

FIG. 7 is a side view of still another device according to the present invention.

FIG. 8 is a cross-sectional view of a portion of the device of FIG. 7 shown with a cap seal for the device.

FIG. 9 is a cross-sectional view of the cap seal shown in FIG. 8 taken along the line 9—9.

FIG. 10 is a sectional view of a further device according to the present invention.

DESCRIPTION OF THE PREFERRED EMBODIMENT(S)

Figure 5:
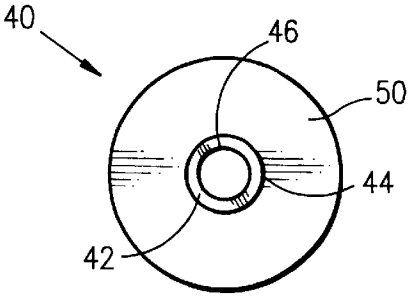
FIG. 5 is an end view of the device of FIG. 4 seen in the direction of arrows 5, 5.

One embodiment of the present invention is illustrated in FIG. 1 and is a method for sealing tie reinforcement hole 10 in concrete wall 12 which has inside surface 13. Inside surface 13 is generally the surface facing the inside of the building structure. Typically, concrete wall 12 is about 12 inches thick and has an outside surface (not shown) opposite inside surface 13. The outside surface typically faces the soil. Tie reinforcement hole 10 is typically ⅝ inch in diameter. The method illustrated in FIG. 1 and the embodiments described hereinbelow preferably seal the first few inches of tie reinforcement hole 10 nearest inside surface 13, unless otherwise stated.

The method of the present invention generally includes (a) inserting stopper 14 into tie reinforcement hole 10, (b) inserting polymeric sealing material 16 into tie reinforcement hole 10, (c) inserting stopper 18 into tie reinforcement hole 10 adjacent polymeric sealing material 16 opposite stopper 14, and (d) pushing stopper 18 into tie reinforcement hole 10 until it compresses polymeric sealing material 16 between stoppers 14 and 18.

Stoppers 14 and 18 used in this method are preferably frusto-cylindrical stoppers, such as corks, preferably standard xxx or xx grade number six corks, or rubber stoppers, e.g., rubber number one stoppers. The frusto-cylindrical stoppers 14 and 18 each have two ends. One end is frustum-shaped, i.e., a cone-shaped solid having a base wherein the tip of the cone is cut off parallel to the base. The base end of the frustum is connected to the other end of the stopper, the other end being a cylindrical body. One end of each of the stoppers has a smaller diameter than the other end. It is preferred that the larger-diameter end has a diameter at least about as large as the diameter of tie reinforcement hole 10 for more adequate sealing.

Polymeric sealing material 16 may be one of many types of sealing materials. However, it is preferred that polymeric sealing material 16 be a hydrophilic rubber in that it absorbs water so that, in the presence of water, it contains the water and swells, providing a better seal inside tie reinforcement hole 10 due to the swelling. Polymeric sealing material 16 may be cured prior to or after insertion into tie reinforcement hole 10. The amount of polymeric sealing material 16 required varies with the sealing method employed. When polymeric sealing material 16 is uncured prior to insertion into a tie reinforcement hole, the polymeric sealing material may be applied from a caulking tube. Examples of suitable polymeric sealing materials include hydrophilic chloroprene-based rubber sealing material and one-component hydrophilic moisture-cure sealants. "HYDROTITE" is a particularly suitable hydrophilic chloroprene-based rubber sealing material available from Greenstreak, St. Louis, Mo. "HYDROTITE" can expand up to eight times its volume when exposed to water.

Other suitable sealing materials include two-component sealing materials, wherein one component is a hardenable polymeric component and the other is a hardener for the hardenable polymeric component. An exemplary two-component sealing material is a water-activated polyurethane resin/water combination.

When polymeric sealing material 16 is cured prior to insertion into tie reinforcement hole 10 and tie reinforcement hole 10 has the typical inner diameter of about ⅝ inch, a piece of cured polymeric sealing material, measuring about ⅝ inch in diameter by ¾ inch long is suitable for the present invention. Determining amounts of other types of polymeric sealing materials is easily done by knowing the desired distance between the two stoppers and the inner diameter of the tie reinforcement hole. For instance, if the desired distance between the two stoppers is 3 inches and the inner diameter is ⅝ inch, the volume of polymeric sealing material desired is $\pi\times(5/8\text{ inch})^2\times 3\text{ inch}=3.68$ cubic inches. If polymeric sealing material 16 is water-swellable, consideration must be given to how much the polymeric sealing material swells upon the presence of water.

One especially suitable method of inserting sealing material 16 into tie reinforcement hole 10 is to insert about one ounce of water-activated resin into tie reinforcement hole 10 and, thereafter, insert a body of water-soaked twisted fiber, such as jute oakum, about two inches in length, into tie reinforcement hole 10. When the water-soaked fiber contacts the water-activated resin, the water-activated resin begins to harden.

A specific form of polymeric sealing material 16 is illustrated in FIGS. 2 and 3 and is generally referred to as sealing capsule 20. FIG. 2 shows a lengthwise cross-sectional view of sealing capsule 20, and FIG. 3 shows a transverse cross-sectional view of sealing capsule 20, the cross section being taken along line 3—3. Sealing capsule 20 has flexible cylindrical enclosed tube 22 having walls formed of porous material, such as open cell polymeric foam. Inside tube 22 are sealed, frangible cell 24 containing hardenable polymeric component 26 and sealed, frangible cell 28 containing hardener 30 for hardening hardenable polymeric component 26. Frangible cells 24 and 28 may be formed of, e.g., latex rubber, such as the material used for forming balloons.

Also inside tube 22 is breaking device 32 for breaking open the frangible cells to allow hardenable polymeric component 26 and hardener 30 to contact each other and, thereby, harden. Breaking device 32 includes rigid strip 34 with sharp appendages 36 thereon so that, when tube 22 is twisted, appendages 36 may break open the frangible cells. Rigid strip 34 may be formed of, e.g., plastic.

In a preferred design of sealing capsule 20, when the tie reinforcement hole is about ⅝ inch in diameter, the outer diameter of sealing capsule 20 is 9/16 inch and the length of sealing capsule 20 is 4 inches.

To use sealing capsule 20 to help seal tie reinforcement hole 10, sealing capsule 20 is flexed, e.g., in a twisting or bending motion, which causes breaking device 32 to pierce holes in frangible cells 24 and 28, thereby releasing the contents of frangible cells 24 and 28. Sealing capsule 20 is preferably further massaged to cause hardenable polymeric component 26 and hardener 30 to thoroughly mix. Once hardenable polymeric component 26 and hardener 30 are mixed, sealing capsule 20 is inserted into tie reinforcement hole 10.

As mentioned, after the desired form of polymeric sealing material 16 has been inserted into tie reinforcement hole 10, stopper 18 is inserted into tie reinforcement hole 10 until it compresses polymeric sealing material 16 between stoppers 14 and 18. Then, the end of tie reinforcement hole 10 facing inside surface 13 may be packed with a body of twisted fiber, such as jute oakum, to contain any outflow of polymeric sealing material.

After polymeric sealing material 16 has hardened or "set", any unfilled portion of tie reinforcement hole 10 near inside surface 13, may be filled flush to inside surface 13 with, e.g., hydraulic cement. Optionally, inside surface 13 may then be painted.

Figure 4:
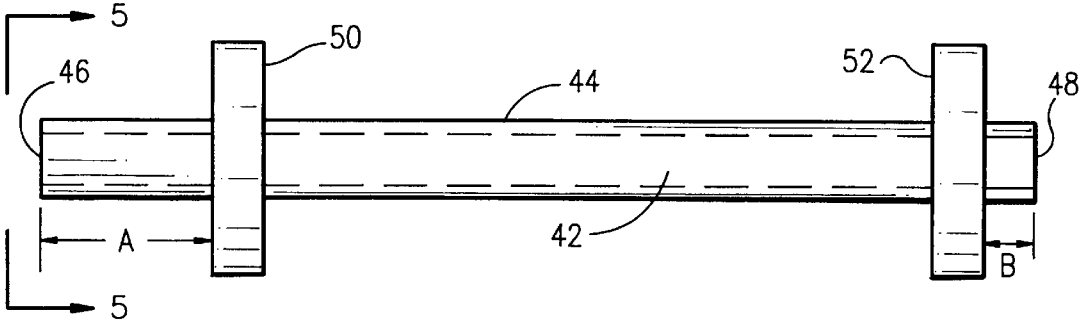
FIG. 4 is a side elevational view of another device according to the present invention, which device is useful in the procedure of sealing tie reinforcement holes.

Another embodiment of the present invention is device 40 of FIGS. 4 and 5, which device is helpful in performing the above-described method of the present invention. Device 40 will hereinafter be referred to as "tie tool 40". FIG. 4 shows a side elevational view of tie tool 40, and FIG. 5 shows an end view of tie tool 40 as seen in the direction of arrows 5, 5.

Tie tool 40 includes elongated body 42 having outside surface 44, ends 46 and 48, and stop rings 50 and 52. Elongated body 42 is shown as a hollow tube. Stop rings 50 and 52 are annular rings protruding from outside surface 44 of elongated body 42. Stop ring 50 is closer to end 46 than is stop ring 52, and stop ring 52 is closer to end 48 than is stop ring 50. In addition, the distance from end 46 to stop ring 50 (distance "A") is farther than the distance from end 48 to stop ring 52 (distance "B"). Tie tool 40 may be made of any material which is strong enough to withstand hammering. For example, tie tool 40 may be formed of metal or any of many types of plastics or composite materials.

In a preferred design of tie tool 40, when the tie reinforcement hole is about ⅝ inch in diameter, the length of tie tool 40 is 11 inches, the outer diameter of elongated body 42 is 9/16 inch, the outer diameters of stop rings 50 and 52 are each 1 1/16 inch, the distance from end 46 to stop ring 50 is 4 inches, the distance from end 48 to stop ring 52 is 1 inch, and the widths of stop rings 50 and 52 are ½ inch.

To use tie tool 40 when sealing a tie reinforcement hole in a concrete wall, end 46 of tie tool 40 is first inserted into the tie reinforcement hole from the inside surface of the concrete wall (e.g., inside surface 13 of FIG. 1). Tie tool 40 is then hammered into the tie reinforcement hole to a depth of distance "A" to clear the tie reinforcement hole of any debris, etc. Conveniently, stop means 50 stops tie tool 40 at being inserted at most distance "A". Tie tool 40 is then pulled partially out of the tie reinforcement hole, keeping about one inch of tie tool 40 in the tie reinforcement hole. The edge of the tie reinforcement hole at the inside surface is then beveled by moving end 48 of tie tool 40 in a circular motion, applying force against the edge of the tie reinforcement hole. The circular motion also removes any loose debris from the edge of the tie reinforcement hole.

After bevelling the edge of the tie reinforcement hole, a stopper such as stopper 14 is inserted into the tie reinforcement hole through the end at the inside surface of the wall, and the stopper is hammered into the tie reinforcement hole flush to the surface of the wall. End 46 of tie tool 40 is then inserted into the tie reinforcement hole again, and tie tool 40 is hammered into the tie reinforcement hole until stop ring 50 meets the edge of the tie reinforcement hole, thereby hammering the stopper into the tie reinforcement hole to a depth of distance "A".

Next, the polymeric sealing material is inserted into the tie reinforcement hole through the end at the wall's inside surface until it (the polymeric sealing material) is essentially flush with the inside surface of the wall. The insertion of the polymeric sealing material may be done in any suitable fashion.

After the polymeric sealing material has been inserted into the tie reinforcement hole, a second stopper, such as stopper 14 is inserted into the tie reinforcement hole through the end at the wall's inside surface until it (the stopper) is essentially flush with the inside surface of the wall. Insertion of the stopper may require hammering. End 48 of tie tool 40 is then inserted into the tie reinforcement hole through the end at the wall's inside surface. Tie tool 40 is then hammered into the tie reinforcement hole until the wall's inside surface meets stop ring 52, thereby driving the second stopper into the tie reinforcement hole a distance "B". The amount of polymeric sealing material should be enough to fill the space between the two stoppers. Therefore, when the second stopper is inserted into the tie reinforcement hole a distance "B", the action expels air from between the two stoppers and compresses the polymeric sealing material.

To carry out the above-described method, a kit may be prepared and sold which contains all of the necessary components. The kit could include two corks or rubber stoppers, a pair of gloves, preferably, disposable plastic quilted gloves, a tie tool, polymeric sealing material, instructions, and the necessary packaging.

Alternative to using tie tool 40, a rod, formed of metal, strong plastic, composite material, or wood, may be used to perform the same functions as tie tool 40. The main difference between using a rod and tie tool 40 is that the rod does not have any stop rings. When the tie reinforcement hole is about ⅝ inch in diameter, it is preferred that the rod have an outside diameter measuring 9/16 inch.

Figure 6:
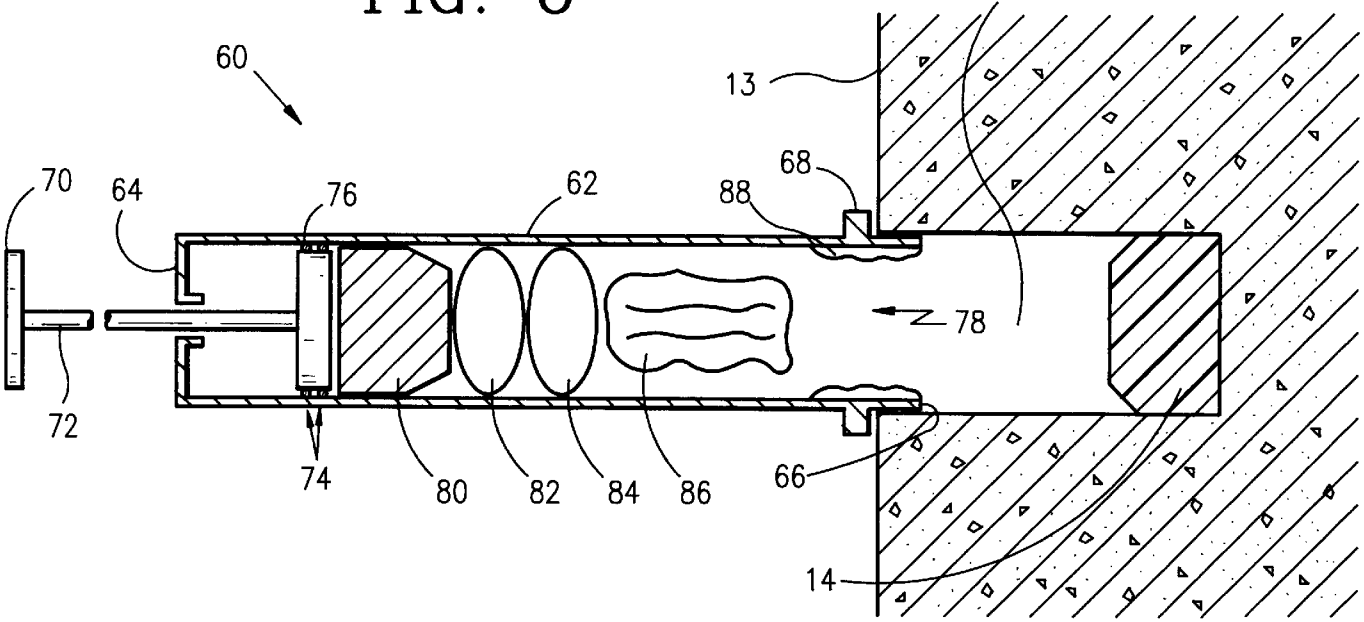
FIG. 6 is a cut-away side view of yet another device according to the present invention.

Another embodiment of the present invention is a device for inserting a sealing material into a tie reinforcement hole of a concrete wall. The device is exemplified by plunger device 60 shown in FIG. 6 and plunger device 90 shown in FIG. 7. Both plunger devices 60 and 90 include a container having two ends, two sealed compartments in the container, an outlet on one end of the container leading from inside the container to outside the container, and a plunger on the other end of the container. The plunger is present for forcing the contents of the container out of the container. One sealed compartment inside the container contains a hardenable polymeric component, and the other sealed compartment contains a hardener for the hardenable polymeric component. Both sealed compartments are sealed so that the hardenable polymeric component and the hardener do not contact each other until use of the device.

Plunger devices 60 and 90 will now be described in detail with the details of plunger device 60 provided first. Plunger device 60 is shown in cut-away fashion with tie reinforcement hole 10 in FIG. 6. Plunger device 60, which may be formed using a syringe, includes container 62 having ends 64 and 66, annular flush mount ring 68 protruding from the outside surface of container 62 near end 66, plunger 70 and stem 72 at end 64, plunger head 74 with O-rings 76 thereon, and outlet 78 at end 66.

Inside container 62 from left to right in the Figure is stopper 80 (similar to stopper 14), frangible sealed compartments 82 and 84, body of twisted fiber 86 (e.g., a two-inch piece of non-oiled jute oakum), and portion of lubricant 88, e.g., petrolatum, coated on the inside surface of container 60 near outlet 78 to facilitate the discharge of the components from plunger device 60. One of the frangible sealed compartments in container 60 contains a hardenable polymeric component, and the other contains a hardener for the hardenable polymeric component. Both frangible sealed compartments 82 and 84 may be formed of latex rubber and are designed to burst when pressure from plunger head 74 is applied to them. Body of twisted fiber 86 is present to provide a body to which the hardenable polymeric component may adhere.

To use plunger device 60, tie reinforcement hole 10 of concrete wall 12 is first cleaned of debris as desired and stopper 14 is inserted into tie reinforcement hole 10 preferably about 4 inches from inside surface 13 of concrete wall 12. Plunger device 60 is then inserted into tie reinforcement hole 10 until flush mount ring 68 abuts inside surface 13 of concrete wall 12. Plunger 70 is then pressed to expel the contents of plunger device 60 into tie reinforcement hole 10 and to cause frangible sealed compartments 82 and 84 to burst open releasing their contents. In so doing, the contents from frangible sealed compartments 82 and 84 harden to form a polymeric sealing material which is compressed between stoppers 80 and 14.

Plunger device 90 shown in FIG. 7 is similar to a caulking tube which is used with a caulking gun, both of which are well-known in the construction industry. Plunger device 90 includes container 92, plunger 94, collapsible film 96, and cone-shaped discharge head 98. Collapsible film 96 is connected at one end to plunger 94 and divides the interior of container 92 into two sealed compartments 97. Plunger 94 is shown having a single plunger head. Alternative to having the single plunger head, each sealed compartment could be equipped with its own plunger head. A hardenable polymeric component is contained in one of the sealed compartments, and a hardener for the hardenable polymeric component is contained in the other of the sealed compartments.

All parts of plunger device 90 may be formed of plastic. More specifically, collapsible film 96 may be formed of "MYLAR" polyester.

To use plunger device 90 to seal a tie reinforcement hole in a concrete wall, the tie reinforcement hole is cleared of debris and beveled as discussed above using a rod or tie tool 40. A stopper, such as stopper 14 is then inserted into the tie reinforcement hole about 4 inches from the inside surface of the concrete wall as discussed above. Plunger device 90 is inserted into a caulking gun, and discharge head 98 is cut, e.g., at dashed line A—A to open plunger device 90. The contents of plunger device 90 are then pumped into the tie reinforcement hole using the caulking gun in the well-known fashion and until the tie reinforcement hole is filled essentially flush to the concrete wall's inside surface.

A second stopper, similar to stopper 14, is then inserted into filled tie reinforcement hole so that it is flush with the inside surface of the concrete wall. Using a rod or tie tool 40, the second stopper is hammered one inch into the tie reinforcement hole. After the polymeric sealing material has hardened, the approximately one-inch void remaining in the tie reinforcement hole may be filled with hydraulic cement flush to the concrete wall's inside surface.

To close discharge head 98, if needed, cap seal 100, shown in FIG. 8, may be used. Cap seal 100 is shown in lengthwise cross-section in FIG. 8 with a portion of discharge head 98 also shown in lengthwise cross-section and having been cut along dashed line A—A of FIG. 7. Cap seal 100 may be any general shape, but is shown as being conical.

Cap seal 100 has opening 102 which is best shown in FIG. 9 which provides a cross-sectional view of cap seal 100, the cross-section taken along line 9—9 in FIG. 8. Opening 102 has circular portion 104 and transverse portion 106, thereby leaving protruding members 108 surrounded by circular portion 104. Dotted lines in FIG. 8 show the proper positioning of cap seal 100 on discharge head 98. One of the protruding members 108 essentially plugs one of the compartments 97 and the other of the protruding members 108 plugs the other of the compartments 97 when cap seal 100 is on discharge head 98.

Another embodiment of the present invention, plug 110, shown in FIG. 10, is another device for sealing a tie reinforcement hole in a concrete wall. Plug 110 includes an elongated cylindrical body, preferably formed of rubber, having ends 112 and 114. Inside plug 110 are two sealed compartments 116, one of which contains a hardenable polymeric component, preferably about one ounce of hardenable polymeric component, and the other of which contains a hardener for the hardenable polymeric component.

Plug 110 also includes seal disk 118 on end 112 and cap 120 on end 114. Seal disk 118 may have any shape so long as it has a flat surface facing end 114 of plug 110. Sealer material 122, such as polyurethane sealant, is present on the surface of seal disk 118 facing end 114. Sealer cover 123 is a removable cover which protects sealer material 122 until ready for use. Cap 120 includes annular channel 124. Plug 110 also includes elongated member 126, such as a wire, extending from end 114 and adapted so that when the elongated member is pulled from plug 110, cap 120 is removed and sealed compartments 116 are opened so that the contents of sealed compartments 116 may contact each other. As shown in FIG. 10, elongated member 126 includes loop 128 inside cap 120 and loop 130 at the other end of elongated member. Loop 128 is affixed in cap 120 where it does not penetrate sealed compartments 116. Elongated member 126 should be long enough so that when plug 110 is inserted into the end of a tie reinforcement hole at a concrete wall's outside surface, loop 128 of elongated member 126 may be reached from the inside surface of the concrete wall.

Plug 110 may be formed of rubber. Elongated member 126, as mentioned may be formed of wire, e.g., non-corrosive wire. Preferably, loop 130 is about 12 inches from the opposing seal disk 118 to be most useful in concrete walls which are 12 inches thick.

To use plug 110, a tie reinforcement hole is first cleared of debris by inserting a rod through the tie reinforcement hole. Plug 110 differs in use from the above described methods and devices in that plug 110 is inserted into a tie reinforcement through the end at the outside surface of a concrete wall.

To begin application of plug 110, sealer cover 123 is removed from sealer material 122. Then, plug 110 is inserted into the tie reinforcement hole from the outside surface of the concrete wall, allowing elongated member 126 to pass through the tie reinforcement hole. Plug 110 is inserted into the tie reinforcement hole until seal disk 118 is abutted against the outside surface of the concrete wall, allowing sealer material 122 to adhere plug 110 to the concrete wall and to seal closed the tie reinforcement hole.

Next, elongated member 126 is pulled away from plug 110 causing plug 110 to tear at annular channel 124, causing cap 120 to be removed from plug 110, and allowing the contents of sealed compartments 116 to empty from plug 110 and contact each other. Elongated member 126 and cap 120 are then discarded. A stopper such as stopper 14 is then inserted into the tie reinforcement hole through the end at the inside surface. The stopper is inserted until it is pressed against plug 110 and its spilled contents. The contents from sealed compartments 116 are then allowed to harden. Then, filler material, such as hydraulic cement is applied to fill the space remaining in the tie reinforcement hole. At this time, the excavated cavity at the outside of the concrete wall may be filled with soil.

Accordingly, the methods and devices of the present invention are useful for sealing tie reinforcement holes, are easy to do and use, and are more effective than prior methods.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced otherwise than as specifically described.

What is claimed is:

1. A device for sealing a tie reinforcement hole in a concrete wall, the device comprising:

a first stopper for insertion into the tie reinforcement hole;

a polymeric sealing material for insertion into the tie reinforcement hole; and a second stopper for insertion into the tie reinforcement hole so that the second stopper keeps the polymeric sealing material in place and compressed against the first stopper;

wherein the first and second stoppers both have two ends, one end on each stopper having a larger diameter than the other end, the diameter of each stopper being tapered from the smaller diameter to the larger diameter for at least a portion of the stopper's length, the larger ends having diameters at least as large as the diameter of the tie reinforcement hole, the stoppers having no openings extending from one end to the other end, and the polymeric sealing material is conformable to the space defined by the first and second stoppers and the tie reinforcement hole.

2. The device of claim 1, wherein the polymeric sealing material is a hydrophilic rubber.

3. The device of claim 1, wherein the polymeric sealing material is a water-swelling hydrophilic sealing material.

4. The device of claim 1, wherein the polymeric sealing material is a one component, hydrophilic moisture-cure sealant.

5. The device of claim 1, wherein the polymeric sealing material is a hydrophilic chloroprene-based rubber sealing material.

6. The device of claim 1, wherein the polymeric sealing material includes a water-activated resin.

7. The device of claim 1, wherein the polymeric sealing material includes an uncured, non-activated one-component water-swelling hydrophilic moisture-curable sealant composition.

8. The device of claim 1, wherein the stoppers are frusto-cylindrical in shape.

9. The device of claim 1, wherein the stoppers are formed of a material selected from the group consisting of cork and rubber.

* * * * *